US005115895A

United States Patent [19]

Myers

[11] Patent Number: 5,115,895

[45] Date of Patent: May 26, 1992

[54] LUGGAGE WITH ASSEMBLED FRAME

[75] Inventor: Jay E. Myers, Newport Beach, Calif.

[73] Assignee: Andiamo, Inc., Fountain Valley, Calif.

[21] Appl. No.: 669,878

[22] Filed: Mar. 14, 1991

[51] Int. Cl.[5] ..... A45C 13/26; A45C 13/36

[52] U.S. Cl. ..... 190/18 A; 190/123; 190/127

[58] Field of Search ..... 190/18 A, 24, 122, 123, 190/127, 107

[56] References Cited

U.S. PATENT DOCUMENTS

| | | | |
|---|---|---|---|
| 3,592,314 | 7/1971 | Jacobson | 190/49 |
| 3,977,501 | 8/1976 | Alonso | 190/127 |
| 4,002,261 | 1/1977 | Litchfield | 220/80 |
| 4,004,664 | 1/1977 | Pelavin et al. | 190/127 |
| 4,176,734 | 12/1979 | Wang | 190/122 |
| 4,418,804 | 12/1983 | Bradley et al. | 190/127 |
| 4,448,292 | 5/1984 | Comfort | 190/107 |
| 4,598,802 | 7/1986 | Abenaim | 190/107 |
| 4,610,333 | 9/1986 | Seynhaeve | 190/18 |
| 4,744,445 | 5/1988 | Anderson et al. | 190/107 |
| 4,770,312 | 9/1988 | O et al. | 220/4 |
| 4,813,520 | 3/1989 | Lin | 190/18 A |

FOREIGN PATENT DOCUMENTS

| | | | |
|---|---|---|---|
| 550901 | 12/1959 | Belgium | 190/122 |
| 485363 | 6/1955 | Italy | 190/122 |
| 81578 | 4/1953 | Norway | 190/122 |

*Primary Examiner*—Gary E. Elkins

*Attorney, Agent, or Firm*—Richard F. Carr; Richard L. Gausewitz; Allan Rothenberg

[57] ABSTRACT

A luggage case is constructed from four flat extruded plastic beams having ribs on one surface, and four inside corner pieces that include tongues extending into the recesses defined by the ribs. Fabric fits over the frame thus provided. Exterior corner pieces overlie the corners of the fabric and are attached to the inner corner pieces. The corner pieces extend the full width of the case to support the fabric. Wheels may be provided to allow the case to be pulled. Cases of different sizes are produced by cutting a plastic extrusion to form beams of different lengths. The same corner pieces are used for cases of all sizes.

25 Claims, 6 Drawing Sheets

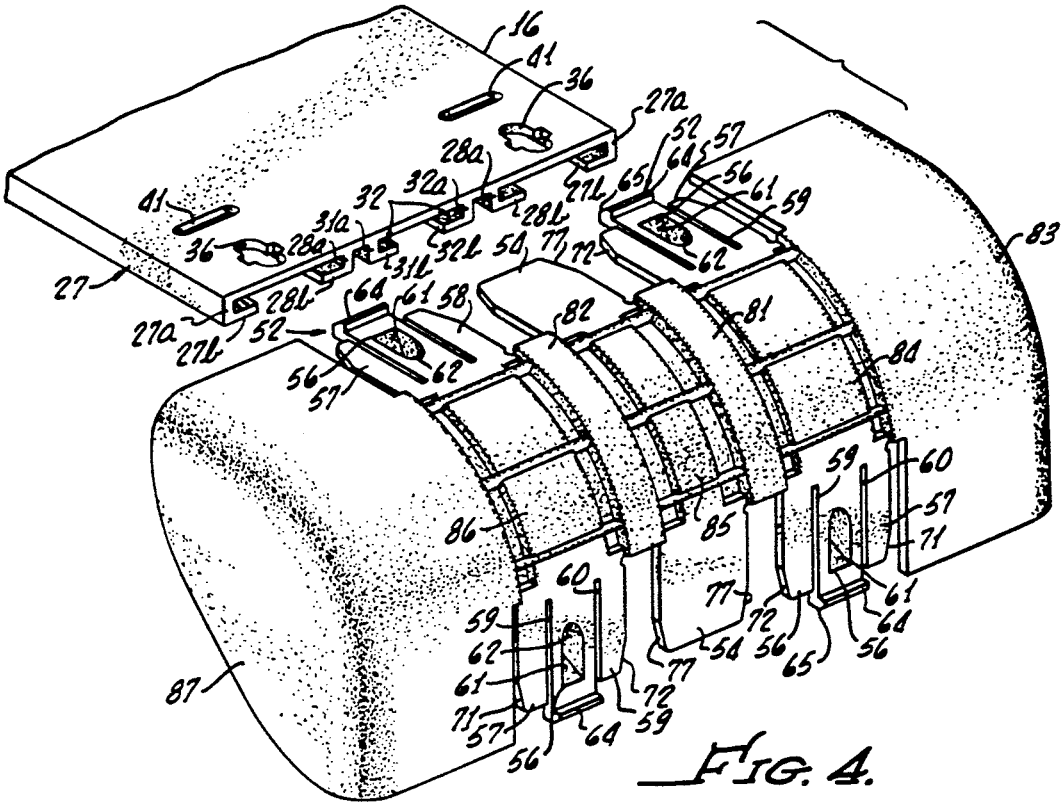
FIG. 4.
FIG. 5.
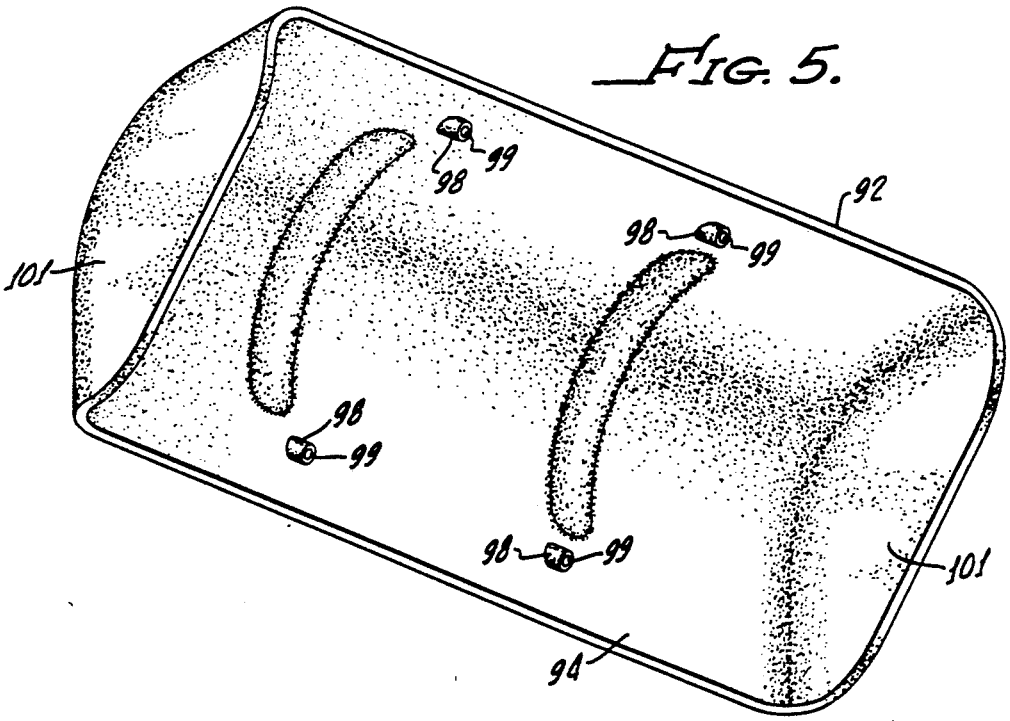

LUGGAGE WITH ASSEMBLED FRAME

BACKGROUND OF THE INVENTION

A universal goal in the production of luggage is a case which is lightweight, durable and inexpensively manufactured. Achievement of all three of these objectives has proved to be elusive. One approach has been to provide a unitary one-piece plastic frame which supports the fabric of a soft-sided luggage case. Properly constructed, such a case can be reasonable durable and of relatively light weight. However, the cost of manufacture is undesirably quite high. This is because the one-piece plastic frame requires a large and expensive mold so that the cost of tooling becomes sizeable. Moreover, each size of case requires its own set of tooling. The mold to produce one frame cannot be used to produce a frame of any other size. Tooling for an entire luggage collection, therefore, becomes excessively costly and can be justified only when extremely high production volume can be achieved. Even so, the cost of tooling remains a factor of expense. Inventory requirements inherently are high, and the frames are bulky so as to require large storage capacity prior to assembly into completed luggage.

A segmented frame for soft-sided luggage is disclosed in U.S. Pat. No. 3,592,314, but this has several drawbacks. It is adapted for production out of metal and so is relatively heavy. It is also costly. A metal frame normally cannot be bent and distorted under service conditions and have the memory to return to its original contour when the stress on it is removed. Hence, it will not possess the durability of a frame constructed out of an appropriate plastic. The frame of this patent provides narrow corner pieces which do not extend the full width of the case at its corners and so do not offer full support across the width of the case at the corners. Also, the fabric covering is exposed at the corners so as to be subject to wear and damage.

BRIEF SUMMARY OF THE INVENTION

The present invention provides an arrangement for lightweight, durable and low cost luggage overcoming the deficiencies of the prior art. Despite its strength, durability and light weight, the luggage of this invention can be produced with a minimal amount of tooling and only a small tooling investment. Parts are interchangeable for cases of different sizes, further adding to the versatility of the production of the case and lowering its cost. Assembly is simple and inexpensive.

The invention provides soft-sided luggage in which a fabric is supported by a substantially rectangular frame. The frame consists of several pieces which are readily assembled into a completed structure. The frame includes four molded plastic corner pieces interlocked with four substantially flat extruded plastic beams. The latter elements are the same for any size of case except for their lengths. For larger sized cases, these extrusions simply are cut to greater lengths than for smaller cases. The corner pieces are identical for cases of different sizes. These elements are provided with tongues at their edges which enter and are stabilized by mating recesses in the extrusions. Separation of the extrusions and the corner pieces is prevented by locking tabs on the corner pieces, as well as by fasteners.

There are also outside corner pieces of molded plastic which fit on the outside of the case over the fabric, protecting the corner areas. The fabric is securely locked between the inside and outside corner pieces. The fasteners extend through the inside corner pieces and into the outside corner pieces to result in a firm and secure attachment. The ends of the outside corner pieces overlap the sides of the fabric slightly to enhance the protection.

The inside and outside corner pieces extend the full width of the luggage case to provide full support for the fabric at the corners.

All of the corner pieces are the same except for one which is modified by being recessed at its ends to receive wheels on which the case may be pulled. The wheels are at a maximum outboard position to provide stability, yet they are recessed to avoid being damaged. A fold-out handle on the opposite end of the case permits the case to be elevated at one end and pulled on the wheels. Of course, if desired, the case can be made with four identical corners and without wheels.

The outside corner pieces may be unitary or consist of different segments that may cover all or only a portion of the outside corners of the case. It is possible to omit the outside corner members, applying the fabric to a frame that includes only the beams and inside corner pieces. However, for strength and durability it is preferred to employ outside corner pieces that fully cover the corners of the case. The prior luggage constructions discussed above lack such outside corners.

BRIEF DESCRIPTION OF THE DRAWINGS

FIG. 4 is a fragmentary perspective view of a corner portion of the frame, viewed from the exterior;

FIG. 5 is a perspective view of an exterior corner piece of the frame, viewed from the interior;

DETAILED DESCRIPTION OF THE INVENTION

Figure 1:
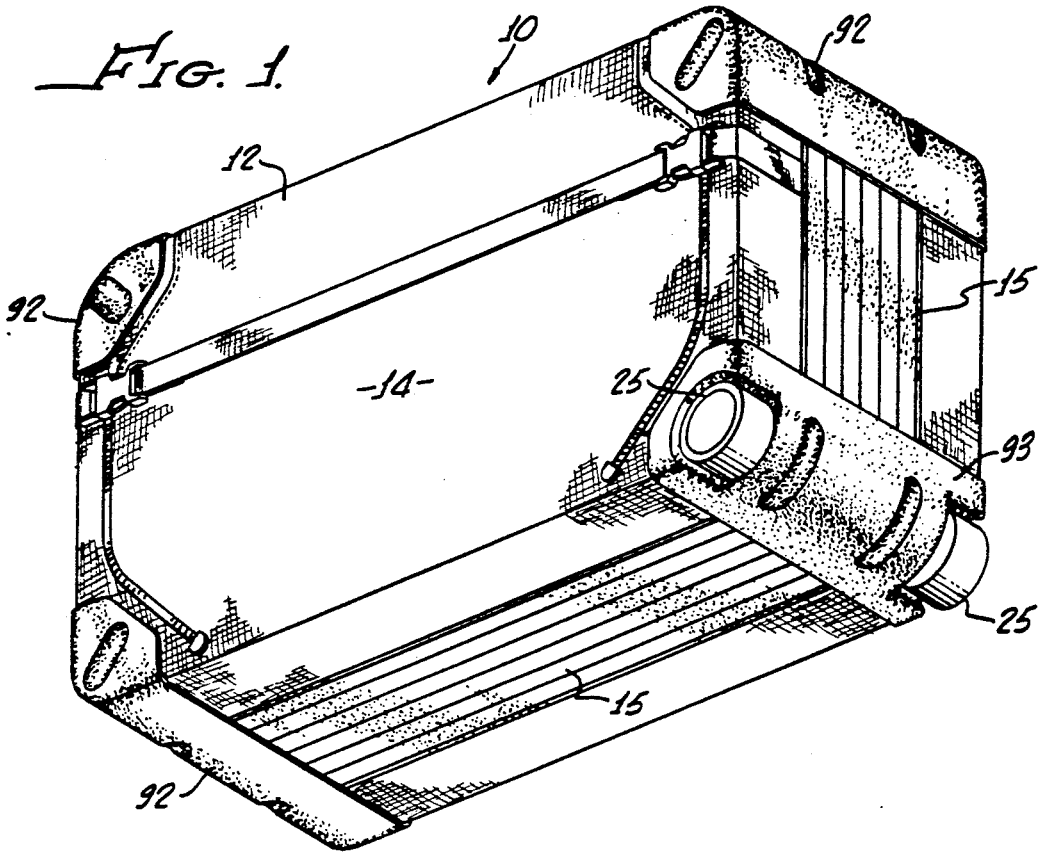
FIG. 1 is a perspective view of a luggage case constructed in accordance with the invention, taken from below and at one end.
Figure 2:
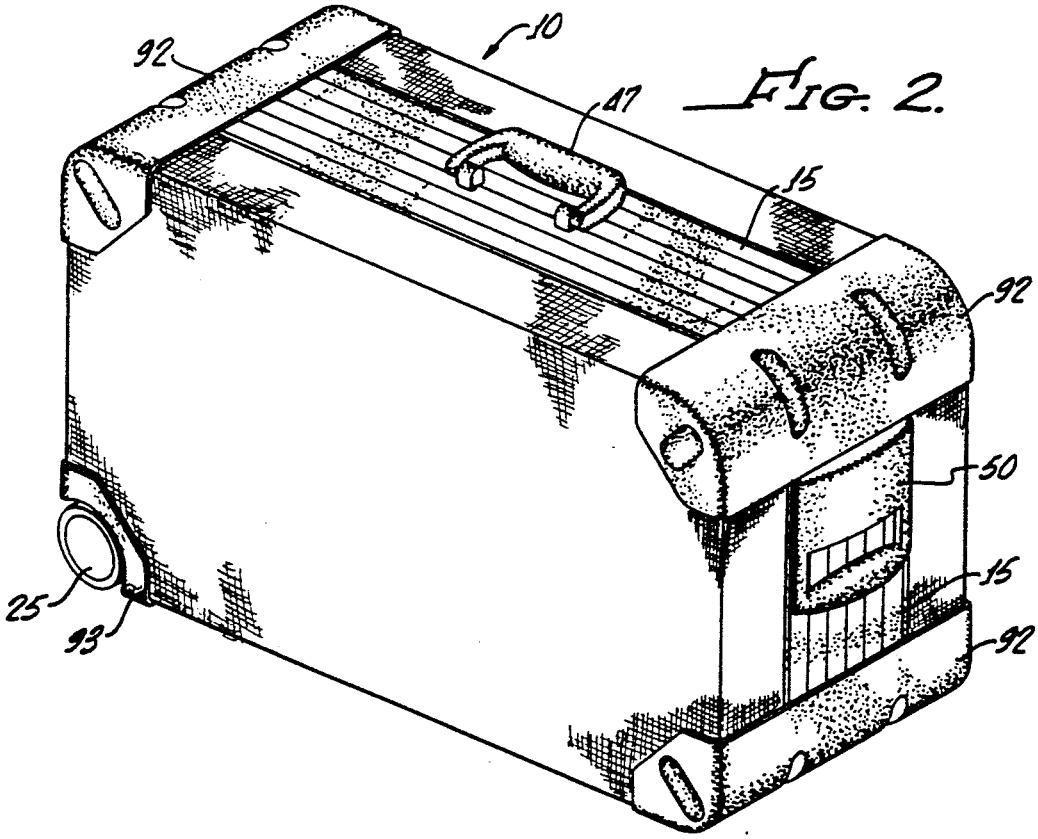
FIG. 2 is a perspective view of the case, taken from above and at the opposite end.
Figure 3:
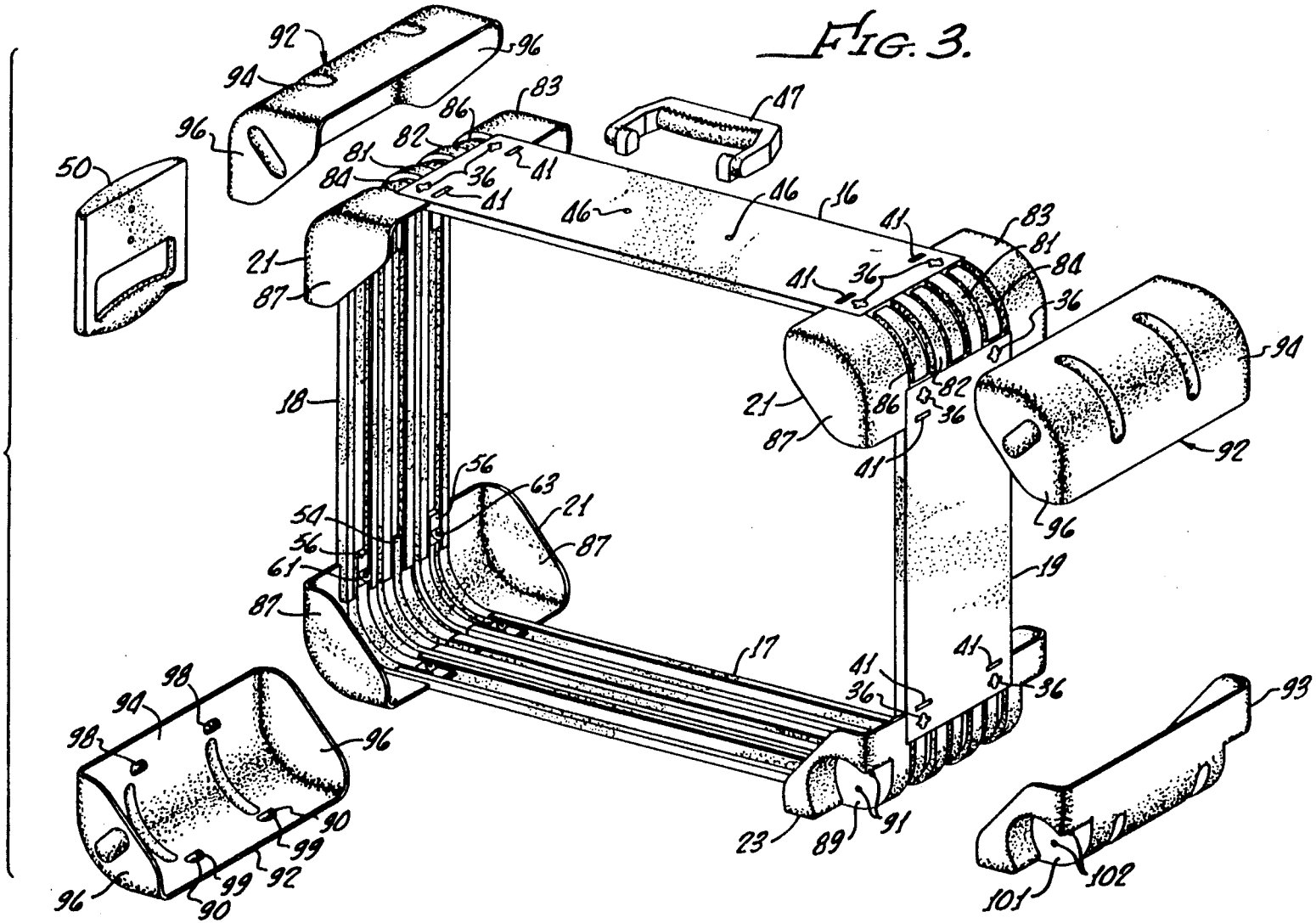
FIG. 3 is an exploded perspective view of the frame of the case.

As illustrated, the arrangement of this invention is used in the construction of a carrying case, in this instance a soft-sided pullman 10, shown in FIGS. 1 and 2, which is of generally rectangular construction. The principal components of the case 10 are a rectangular frame 11 (FIG. 3) over which is a flexible sheet material 12, such as a fabric. A zipper closure 13 may be provided on one of the principal sides 14 of the case. Decorative trim strips 15 also may be included.

The frame 11 includes a pair of opposed spaced parallel generally flat extruded plastic beams 16 and 17 which are of the same length and form the top and bottom parts of the frame, respectively. An additional pair of similar but shorter extrusions 18 and 19 is positioned at right angles to the extrusions 16 and 17 and provides the ends of the frame. These extruded beams are interconnected by four inside corner pieces, preferably of molded plastic. Three of these corner pieces 21 are identical, while a fourth corner member 23 has a provision to mount wheels 25, as discussed below.

Figure 6:
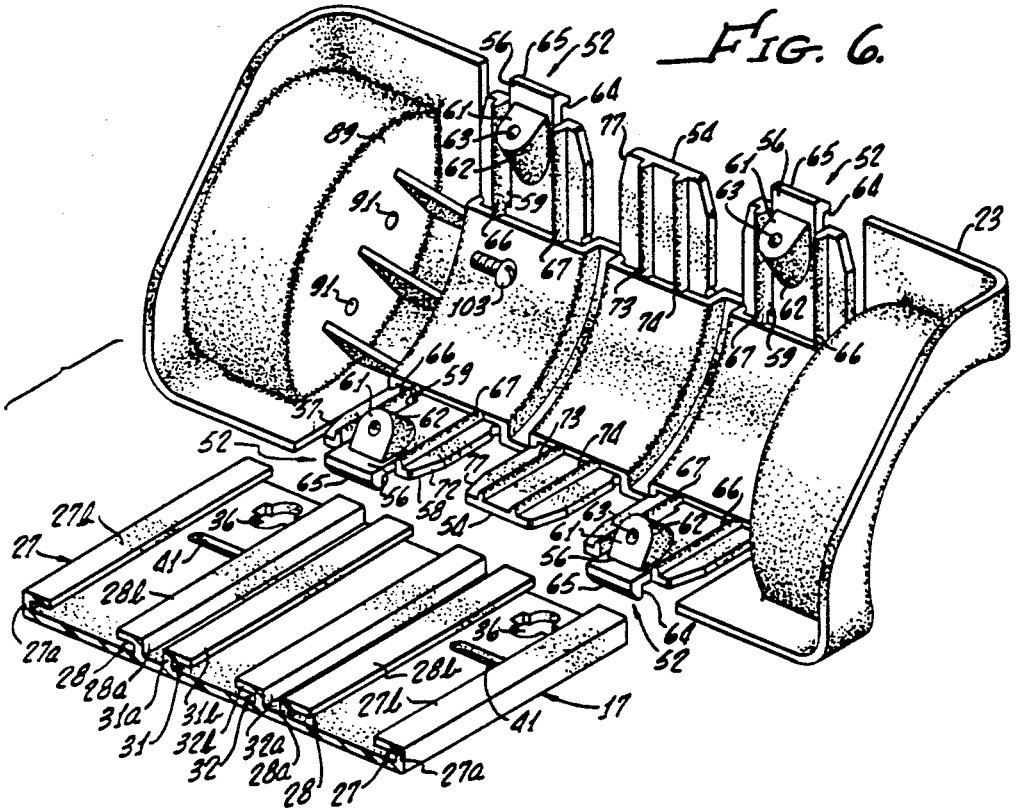
FIG. 6 is a fragmentary perspective view of a corner portion of the frame, viewed from the interior.
Figure 7:
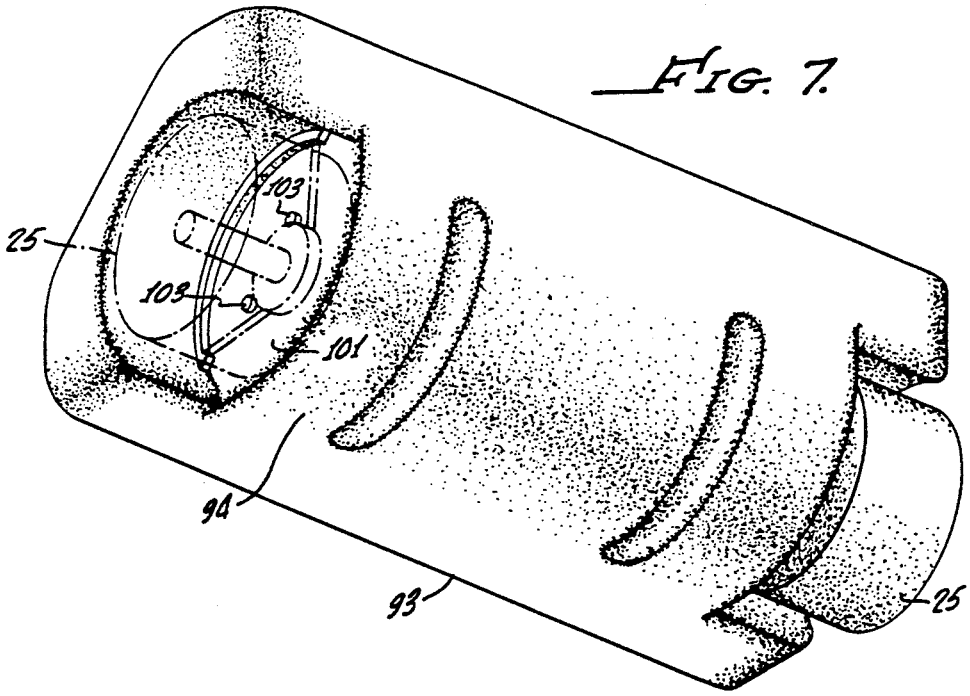
FIG. 7 is an external perspective view of an outside corner piece which has provision for wheels.
Figure 9:
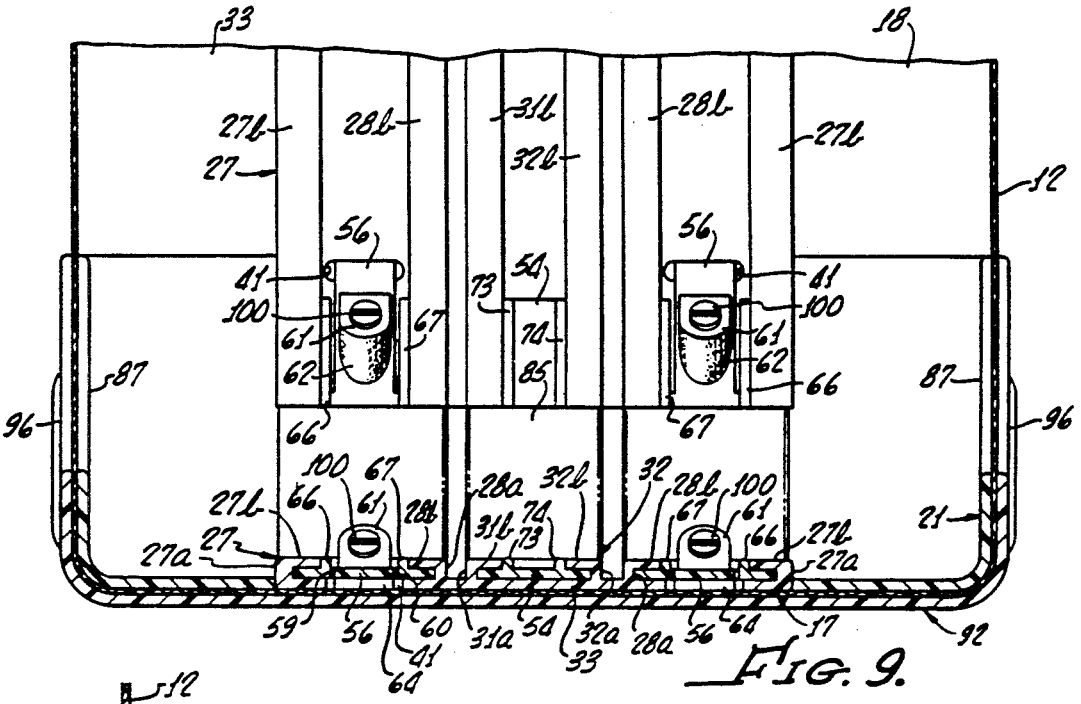
FIG. 9 is a transverse sectional view taken along line 9—9 of FIG. 8.
Figure 8:
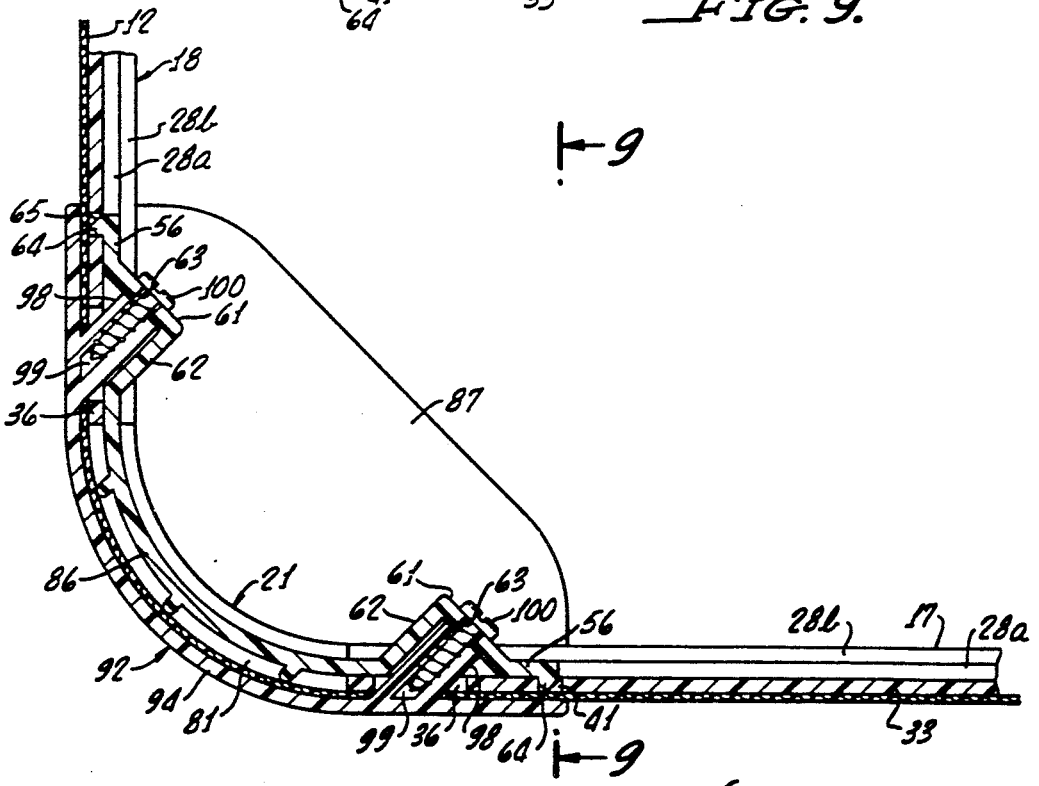
FIG. 8 is an enlarged sectional view of a corner portion of the completed case.
Figure 10:
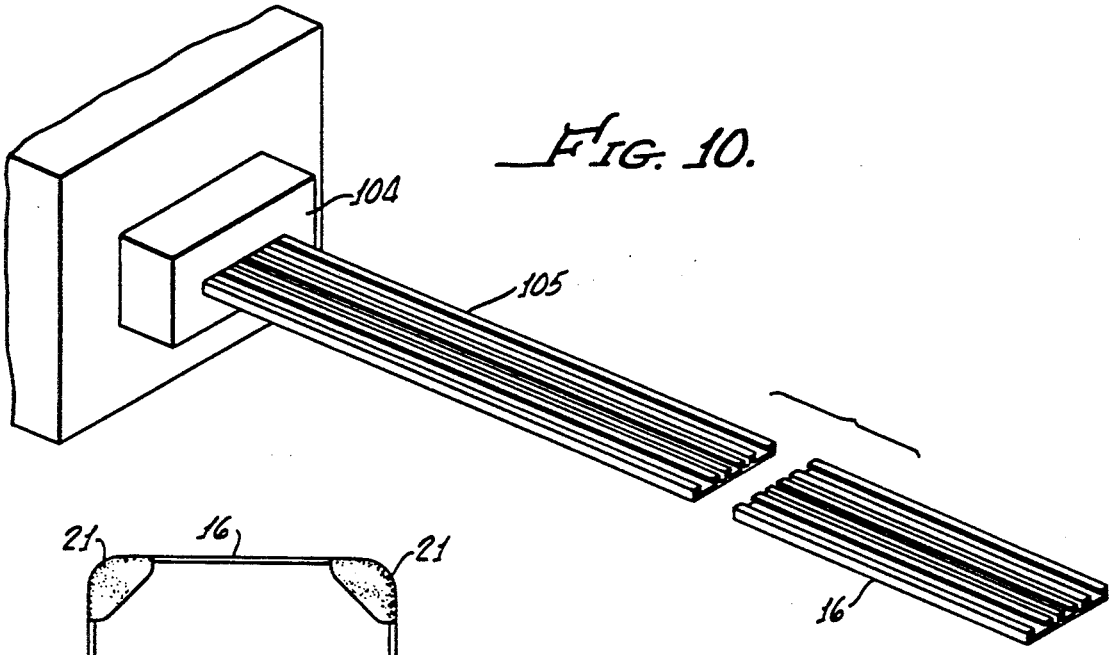
FIG. 10 is a perspective view illustrating the formation of the extruded beams of the frame.

All of the beams 16, 17, 18 and 19 may be formed from the same extrusion die, thus having the same cross-sectional configuration. Each of these extrusions has a planar outer surface and an inner surface provided with three sets of opposed longitudinally extending flanges or ribs. As seen in FIGS. 4 and 6, this includes two outer sets of opposed flanges 27 and 28, and a third set 31 and 32 between them. The spacing between the flanges 27 and 28 is slightly greater than that between the flanges 31 and 32. Each of the flanges is L-shaped, including a portion projecting at right angles from the flat principal wall 33 of the extrusion, as well as a rail parallel to the wall 33 connected to the outer end of the projecting portion. For example, the flange 27 includes a perpendicular portion 27*a* and an outer rail 27*b* that is parallel to the wall 33. Similar parts 28*a* and 28*b* make up the flange 28. The flanges 31 and 32 are made up of perpendicular parts 31*a* and 32*b*, respectively, and outer rails 31*b* and 32*b*. The rail portion 27*b* extends toward the flange 28, while the rail portion 28*b* extends toward the flange 27. The flanges of the extruded beams provide recesses that help lock the beams to the corner members 21 and 23, and also add stiffness and strength to the beams.

An elongated opening 36 extends through the wall 33 adjacent either end of the extrusion and between each set of flanges 27 and 28. Inwardly of the openings 36 are transverse slots 41 through the wall 33.

An additional pair of openings 46 is provided through the upper frame extrusion 16 for attachment of a handle 47 used for carrying the case 10. The end extrusion 18 also has an additional pair of openings 49 through its central part near the upper end for attachment of a fold-out handle 50 used in pulling the case 10 on its wheels 25.

Although the extruded beams 16, 17, 18 and 19 are relatively wide, the corner pieces 20 and 23 are of greater dimension transversely of the frame than are the beams. The central portions of the corner pieces are arranged to interlock with the extruded beams to form a rigid and secure connection. The corner pieces are arcuate so as to present opposite edges 90 degrees apart. Each of these edges is provided with three spaced tongues which project outwardly and fit within the recesses defined by the flanges 27 and 28, and 31 and 32. This includes two identical outer tongues 52 and a tongue 54 of a different configuration positioned between them. Each of the tongues 52 is in three segments, including a relatively wide central part 56 and two parallel shorter side parts 57 and 58. Elongated slots 59 and 60 separate the side tongue portions 57 and 58 from the central part 56.

The central part 56 is mostly flat, but includes a recess in its inner surface defined by a flat wall 61 and an arcuate wall 62 perpendicular to it. An opening 63 extends through the wall 61. At the outer end of the central tongue portion 56 is an outwardly projecting tab 64 which is perpendicular to the plane of the tongue and which has a beveled outer edge 65.

The tongue portions 57 and 58 are flat except for upstanding ridges 66 and 67, respectively, which are adjacent the slots 59 and 60. The outside corners of the side tongue portions 57 and 58 provide beveled edges 71 and 72 to facilitate entry between the flanges 27 and 28. The slots 59 and 60 allow some deflection of the side tongue portions to further facilitate the entry of the tongues into the recesses.

The central tongue 54 also is flat with the exception of elongated ridges 73 and 74 which extend the length of the tongue 54. The outer corners 77 of the tongue 54 are beveled.

In the assembled frame, the side tongue portions 57 and 58 fit between the wall 33 and the rails 27*b* and 28*b*, with the ridges 66 and 67 positioned alongside the inner edges of the rails 27*b* and 28*b*. Similarly, the side edge portions of the tongues 54 fit between the wall 33 and the rails 31*b* and 32*b*, and the ridges 73 and 74 are adjacent the inner edges of these rails.

As seen from the exterior, each corner piece 21 includes two arcuate ribs 81 and 82 between the central tongue 54 and the side tongues 52. At the side edge portions of the corner piece is a principal surface 83 which is of the same height and curvature as the ribs 81 and 82. Exterior ribs 84, 85 and 86 are recessed slightly below the ribs 81 and 82, and the surface 83. End walls 87 connect to the ends of the surface 83 and extend over the end portions of the inner corner piece 21, being perpendicular to the edges of the corner piece and extending therebetween.

The corner piece 23 is the same as the others except that the surface 83 is of shorter dimension and the end walls 89 are positioned inwardly of the outer ends of the corner piece to provide recesses for the wheels 25. Openings 91 through the end walls 89 allow for attachment of the wheels.

When the frame is assembled, the tabs 64 of the tongues 56 enter the transverse slots 41 to provide a locking effect and resist forces tending to pull the corner pieces and the extruded beams apart. The fabric 12 fits over the assembled frame and is supported by it. Preferably the frame is dimensioned so as to impart tension to the fabric around the perimeter.

Exterior corner pieces 92 and 93 cover the corners of the fabric 12 and fit over the inner corner pieces 21 and 23, respectively. The exterior corner piece 92 includes a wall 94 having an arcuate central portion connecting to flat edge portions for overlying the arcuate portions and the flat tongues of the inner corner piece. There are, in addition, end walls 96 which overlie the end walls 86 and 87 of the inner corner piece. The interior of the outer corner piece 92 is dimensioned to be just slightly larger than the outer dimension of the inner corner piece 21 at the ribs 81 and 82 and the surface 83 to allow for the thickness of the fabric 12.

On the interior of the outer corner piece 92 are four bosses 98, each with a blind opening 99. When the corner pieces 91 are extended over the corners of the case, the bosses 98 extend through openings provided in the fabric 12 and into the recesses defined by the surfaces 61 and 62 of the tongues 56 of the interior corner piece 21. In entering the recesses in the interior corner piece, the bosses 98 also extend through the openings 36 in the extruded beams 16, 17, 18 and 19. Fasteners 100 then are extended through the openings 63 and into the blind openings 99 to tap threads and secure the inner and outer corner pieces together. This securely holds the frame in an assembled position and also locks the fabric 12 between the inner and outer corner pieces.

At the corner with the wheels 25, the outer corner piece 93 is similar to the others, but has recessed end walls 101 which overlie the end walls 89 of the inner corner piece 23. Openings 102 in the end walls 99 permit fasteners 103 to be extended through the inner and outer corner pieces to engage the wheel assemblies 25 and hold them to the case. This securely mounts the wheels 25 such that they are recessed into the corner pieces for protection, yet located near the edges of the case to provide a wide tread and maximum stability when the case is pulled on its wheels.

The manufacture of luggage cases is illustrated in FIGS. 10, 11*a*, 11*b* and 11*c*. First, a quantity of plastic is extruded through a die 104 to provide a strip 105 having the cross section of the beams 16, 17, 18 and 19. The strip 105 then is cut to appropriate lengths corresponding to the beams and the openings 36, 41, 47 and 49 are formed as needed to complete the beams.

Figure 11A:
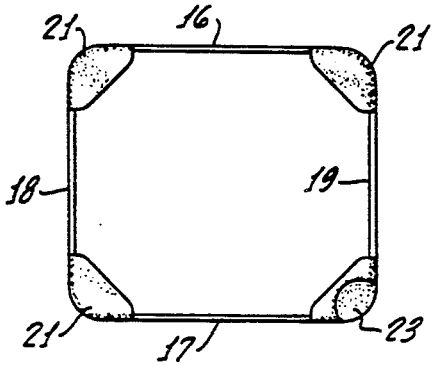
FIGS. 11*a*, 11*b* and 11*c* are side elevational views illustrating the construction of frames of different sizes.
Figure 11B:
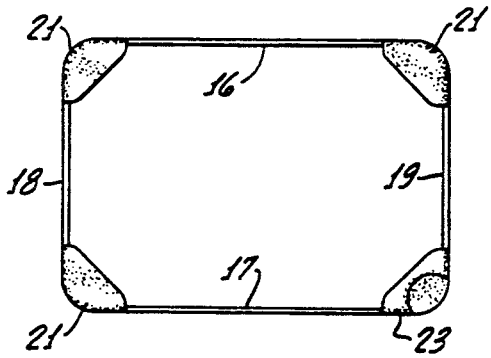
Figure 11C:
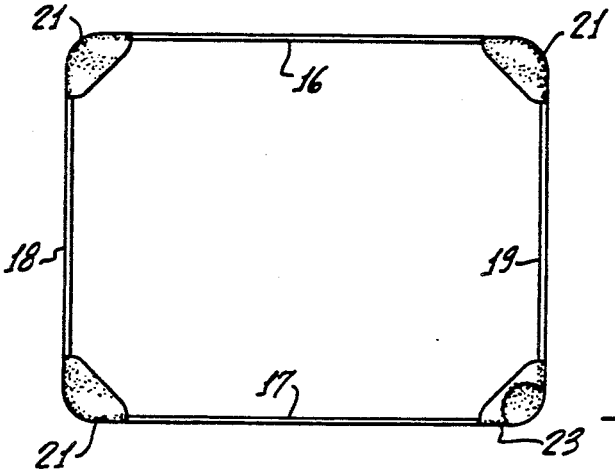

For a case of relatively small size, the strip 105 is cut to provide beams 16, 17, 18 and 19 of the lengths indicated in FIG. 11*a*, which are assembled with corner pieces 21 and 23. A larger case may be made by cutting the strip 105 to provide beams 16 and 17 of greater length, as seen in FIG. 11*b*. In this instance the beams 18 and 19 are cut to the same length as before. Corner pieces 21 and 23 again are employed. A still bigger case is shown in FIG. 11*c*. Here the strip 105 has been cut to provide longer beams 18 and 19, as well as the longer beams 16 and 17. As before, corner pieces 21 and 23 are used to interconnect the beams. In all instances, the same outer corner pieces 92 and 93 are employed. Thus, manufacture of cases of different sizes is accomplished with no additional tooling and with the same assembly techniques.

The foregoing detailed description is to be clearly understood as given by way of illustration and example only, the spirit and scope of this invention being limited solely by the appended claims.

What is claimed is:

1. An item of luggage comprising a substantially rectangular frame including a first pair of opposed spaced substantially flat members, a second pair of opposed spaced substantially flat members, and four inside corner members, each interconnecting one of said substantially flat members of said first pair with one of said substantially flat members of said second pair, thereby to define a substantially rectangular shape, said corner members and said substantially flat members at each such interconnection including cooperating interlocking means, a quantity of flexible sheet material defining a container and extending over and supported by said first and second pairs of substantially flat members and said corner members, four outside corner members, each overlying said sheet material and one of said inside corner members, whereby said sheet material is held between said inside and outside corner members, and means for interconnecting said inside and outside corner members.

2. A device as recited in claim 1 in which said means for interconnecting said inside and outside corner members includes fasteners extending between the same.

3. A device as recited in claim 1, including two wheels located one at each outer end portion of one of said outside corner members, and fastener means connecting said wheels to said one outside corner member and the inside corner member which it overlies for providing a means for moving said item of luggage on wheels.

4. A device as recited in claim 3 in which said one outside corner member includes recesses at the opposite ends thereof, said wheels being received in said recesses.

5. A device as recited in claim 1 in which at least a portion of each outside corner member complementarily receives one of said inside corner members except for a space substantially equal to the thickness of said sheet material, said sheet material being received in said space and closely confined therein by said inside and outside corner members.

6. A device as recited in claim 1 in which said substantially flat members and said inside corner members are provided tab means on one and recess means in the other receiving said tab means, thereby providing said means for interconnecting said substantially flat members and said inside corner members.

7. A device as recited in claim 6 in which said tab means are on said inside corner members.

8. A device as recited in claim 1 in which for said means for interconnecting said substantially flat members with said inside corner members includes elongated recesses in said substantially flat members and projecting means on said corner members received in said recesses.

9. A device as recited in claim 1 in which for said means for interconnecting said substantially flat members with said inside corner pieces includes a plurality of ribs on said substantially flat members, and tongues on said corner pieces received between said ribs.

10. A device as recited in claim 9 in which each of said substantially flat members includes a substantially planar wall, and said ribs include first portions projecting outwardly from said wall, and second portions extending from said first portions over said wall in a spaced relationship therewith.

11. An item of luggage comprising a substantially rectangular frame including a first pair of opposed spaced parallel substantially flat beams, a second pair of opposed spaced parallel substantially flat beams positioned perpendicular to said first pair, all of said beams being of extruded plastic and having the same cross-sectional shape, each of said beams defining at least one longitudinal recess extending the length thereof and having open ends, and four corner pieces each of which interconnects one beam of said first pair with one beam of said second pair, each of said corner pieces including two edge portions angularly spaced 90 degrees apart, each edge portion including a part received in said recess of each of said beams so interconnected, and a quantity of flexible sheet material extending over said rectangular frame and supported thereby so as to define a container therewith.

12. A device as recited in claim 11 in which each of said beams includes two ends and an opening adjacent and spaced inwardly from each of said ends, and said part of said edge portions of said corner pieces include tab means received in said openings for resisting forces tending to separate said beams and said corner pieces.

13. A device as recited in claim 11 in which each of said beams includes a substantially flat wall, and each of said beams includes a plurality of parallel flanges, each of said flanges including a first portion projecting outwardly from said wall and a second portion at the outer edge of said first portion, said second portion extending over and being spaced from said wall, said second portions of two adjacent ones of said flanges projecting toward each other for thereby forming said recess.

14. A device as recited in claim 13 in which said first portions of said flanges are substantially perpendicular to said wall and said second portions of said flanges are substantially parallel to said wall.

15. A device as recited in claim 13 in which said parts of said corner pieces are tongues projecting into said recesses.

16. A device as recited in claim 15 in which said tongue include portions between said wall and said second portions of said flanges, and rib portions positioned adjacent said second portions of said flanges.

17. A device as recited in claim 16 in which said tongues include a central portion and two side portions separated from said central portion by slots, said rib portions being on said side portions.

18. A device as recited in claim 17 in which said central portions are longer than said side portions.

19. A device as recited in claim 11 in which transversely of said frame said corner pieces have a greater dimension than said beams, and extend the full width of said sheet material, and said corner pieces have end portions perpendicular to said edge portions and extending therebetween.

20. A device as recited in claim 11 including in addition four outside corner pieces extending over said sheet material and over said inside corner pieces, and including means for connecting said outside corner pieces to said inside corner pieces and to said beams.

21. A device as recited in claim 20 in which, said beams include two ends and are provided with openings therethrough adjacent the ends thereof, said outside corner pieces having portions extending into said openings, said portions of said outside corner pieces having openings therein, said inside corner pieces having openings aligned with said openings in said outside corner pieces, and including fasteners extending between said openings in said inside corner pieces and said openings in said outside corner pieces, for thereby providing said means for connecting said outside corner pieces to said inside corner pieces and to said beams.

22. A device as recited in claim 21 in which said inside corner pieces include recesses receiving said portions of said outside corner pieces.

23. An item of luggage comprising a frame including a first pair of opposed spaced beams, a second pair of opposed spaced beams, and four inside corner members, each interconnecting one of said opposed spaced beams of said first pair with one of said opposed spaced beams of said second pair, thereby to define as enclosed four-sided shape, a quantity of flexible sheet material defining a container and extending over and supported by said frame, four outside corner members, each overlying said sheet material and one of said inside corner members, whereby said sheet material is held between said inside and outside corner members, and means for interconnecting said inside and outside corner members.

24. A device as recited in claim 23 in which said inside corner members have a greater dimension transversely of said frame than that of said beams, said inside corner members defining the width of said container.

25. A device as recited in claim 23 in which said beams are of extruded plastic and all have the same cross-sectional configuration.

* * * * *

UNITED STATES PATENT AND TRADEMARK OFFICE

CERTIFICATE OF CORRECTION

PATENT NO. : 5,115,895

DATED : May 26, 1992

INVENTOR(S) : Jay E. Myers

It is certified that error appears in the above-indentified patent and that said Letters Patent is hereby corrected as shown below:

Column 6, line 4, claim 6, after "means" insert --for --.
line 1, claim 8, after "which," delete "for".
line 1, claim 9, after "which", delete "for".

Column 7, line 2, claim 16, remove "tongue" and insert --tongues --.

Signed and Sealed this

Fourteenth Day of September, 1993

Bruce Lehman

*Attest:*

BRUCE LEHMAN

*Attesting Officer*

*Commissioner of Patents and Trademarks*